US005664630A

United States Patent [19]

Meyer et al.

[11] Patent Number: 5,664,630

[45] Date of Patent: Sep. 9, 1997

[54] EXTENDED COVERAGE CEILING SPRINKLERS AND SYSTEMS

[76] Inventors: George G. Meyer, 402 Bodine Rd.; Stephen J. Meyer, Valley Hill, both of Malvern, Pa. 19355; George S. Polan, 102 Alexander Dr., Perkiomenville, Pa. 18074

[21] Appl. No.: 227,430

[22] Filed: Apr. 14, 1994

Related U.S. Application Data

[63] Continuation-in-part of Ser. No. 875,928, Apr. 29, 1992, Pat. No. 5,366,022, which is a continuation-in-part of Ser. No. 769,917, Sep. 30, 1991, abandoned.

[51] Int. Cl.[6] ..... A12C 35/68

[52] U.S. Cl. ..... 169/37; 169/38; 169/39

[58] Field of Search ..... 169/37, 40, 38, 169/39, 41

[56] References Cited

U.S. PATENT DOCUMENTS

| | | | |
|---|---|---|---|
| D. 251,128 | 2/1979 | Groos et al. | D23/6 |
| D. 348,719 | 7/1994 | Dolan | D23/214 |
| 1,727,111 | 9/1929 | Moore | 169/37 |
| 2,279,374 | 4/1942 | Jung | 239/498 |
| 2,550,456 | 4/1951 | De Flon | 239/498 |
| 2,558,450 | 6/1951 | Martin | 169/37 |
| 2,697,008 | 12/1954 | Rowley | 299/121 |
| 2,724,614 | 11/1955 | Rider | 299/121 |
| 3,195,647 | 7/1965 | Campbell et al. | 169/40 |
| 3,459,266 | 8/1969 | Ault | 169/41 |
| 3,682,251 | 8/1972 | Livingston | 169/37 |
| 3,714,989 | 2/1973 | Gloeckler | 169/39 |

(List continued on next page.)

FOREIGN PATENT DOCUMENTS

| | | | |
|---|---|---|---|
| 765125 | 1/1957 | United Kingdom . | |
| 1027930 | 4/1966 | United Kingdom | 169/37 |

OTHER PUBLICATIONS

"Automatic" Sprinkler Corporation of America product sheet entitled Automatic ESFR Glass Bulb Sprinkler J 5.3, Feb., 1988, and J 5.4, 1988 (2 pp. total).

Sheet entitled "Grinnell Jumbo Sprinkler Issue A", Grinnell Corp., Feb., 1969, (1 pg.).

Sheet entitled "Grinnell Protectospray Nozzle Type D3 (Large Capacity)", Grinnell Corporation, Apr., 1964,(1 pg.).

Bulletin No. 211 entitled "Sprinklers, Nozzles and Accessories/Section 4 Duraspeed® Sprinkler–Rack Storage—Q–17", Grinnell Corporation, Jan., 1975 (2 pp.).

(List continued on next page.)

*Primary Examiner*—Gary C. Hoge

*Attorney, Agent, or Firm*—Panitch Schwarze Jacobs & Nadel, P.C.

[57] ABSTRACT

Ceiling sprinklers and sprinkler systems provide extended areas of ordinary and light hazard coverage through a combination of orifices with K factors greater than 9 and deflectors which extend water distributions radially with acceptable uniform average and absolute distribution densities all around and beneath the sprinklers. Described deflectors for concealed sprinklers are circular with slots extending axially and radially through inwardly towards the center of the deflector from the circular perimeter. Such deflectors include a central curved protrusion extending back towards the outlet to spread the water column over the deflecting structure and a surrounding planar annular area of the structure. The deflectors are supported on pins to telescope away from the sprinkler body and drop below or farther below the lower surface of the ceiling in which they are installed. Sprinkler systems of the present invention can be installed with closest adjoining pairs of sprinklers and branch lines spaced more than fifteen feet apart and up to twenty-feet apart when the sprinklers are located within at least seven and one-half feet and as close as only three feet or less above the protected area.

18 Claims, 2 Drawing Sheets

U.S. PATENT DOCUMENTS

| | | | |
|---|---|---|---|
| 3,722,596 | 3/1973 | Livingston . | |
| 3,874,455 | 4/1975 | Klesow | 169/19 |
| 3,888,313 | 6/1975 | Freeman | 169/37 X |
| 3,904,126 | 9/1975 | Allard . | |
| 4,014,388 | 3/1977 | Anderson | 169/37 |
| 4,015,665 | 4/1977 | Simmons et al. | 169/40 |
| 4,066,129 | 1/1978 | Anderson | 169/37 |
| 4,099,675 | 7/1978 | Wohler et al. | 169/37 X |
| 4,136,740 | 1/1979 | Groos et al. | 169/39 |
| 4,279,309 | 7/1981 | Fischer et al. | 169/37 |
| 4,405,018 | 9/1983 | Fischer | 169/37 |
| 4,491,182 | 1/1985 | Pieczykolan | 169/38 |
| 4,508,175 | 4/1985 | Pieczykolan | 169/38 |
| 4,553,602 | 11/1985 | Pieczykolan | 169/19 |
| 4,569,289 | 2/1986 | Gielow et al. | 105/2 R |
| 4,580,729 | 4/1986 | Pounder | 239/524 |
| 4,618,001 | 10/1986 | Hoening | 169/23 |
| 4,624,414 | 11/1986 | Ferrazza | 239/467 |
| 4,630,682 | 12/1986 | Pieczykolan | 169/38 |
| 4,699,217 | 10/1987 | McLennan et al. | 169/37 |
| 4,791,993 | 12/1988 | Curran | 169/37 X |
| 4,800,961 | 1/1989 | Klein . | |
| 4,880,063 | 11/1989 | Leininger et al. | 169/37 |
| 4,901,799 | 2/1990 | Pepi et al. | 169/37 X |
| 4,923,013 | 5/1990 | De Gennaro | 169/37 X |
| 4,930,578 | 6/1990 | Barnett et al. | 169/39 |
| 4,964,574 | 10/1990 | Daigle . | |
| 4,976,320 | 12/1990 | Polan | 169/40 |
| 4,991,656 | 2/1991 | Polan | 169/38 |
| 5,020,601 | 6/1991 | Retzloff et al. | 169/37 |
| 5,080,176 | 1/1992 | Polan et al. | 169/37 |
| 5,083,616 | 1/1992 | Polan | 169/40 |
| 5,094,298 | 3/1992 | Polan | 169/41 |
| 5,299,645 | 4/1994 | Hoening et al. | 169/39 |
| 5,372,203 | 12/1994 | Galaszewski | 169/37 |

OTHER PUBLICATIONS

Bulletin No. 301 entitled "Sprinklers, Nozzles and Accessories/Section 4 Quartzoid Sprinkler—Large Orifice Styles: Pendent—Upright—Old Style", Grinnell Fire Protection Systems Company, Inc., Dec., 1973, (2 pp.).

Sheet entitled "Grinnell Quartzoid Sprinkler, Issue D Large Orifice—¾" N.P.T. Connection", Grinnell Corporation, Sep., 1971 (1 pg.).

Sheets entitled "Large Orifice Upright & Pendent Sprinklers Issue D Bulb Type, 17/32" Orifice—½" N.P.T. Connection", Grinnell Corporation, Aug., 1978, (2 pp.).

Bulletin No. 305 entitled "Sprinklers Nozzles and Accessories/Section 4 Quartzoid Pull Type Sprinkler Style: Pendent, Upright, Old Style", Grinnell Fire Protection Systems Company, Inc., Jul., 1974, (2 pp.).

Sheet entitled Grinnell Quartzoid Sprinkler, Issue D Pull Type, Grinnell Corporation, Sep., 1971 (1 pg.).

Sheet entitled "Grinnell Quartzoid Sprinkler Issue–D", Grinnell Company, Inc., Nov., 1959,(1 pg.).

Sheet entitled "Grinnell Q16 Sprinklers Engineering Data", Grinnell Corporation, Sep. 1971 (1 pg.).

Sheets entitled "Sprinkler Discharge Characteristics" or Sprinkler Data Sheet—% Penetration or Sprinkler Data Sheet—10' Radius or Sprinkler Distribution—Turn Table—Data Sheet with Grunau Upright, .64 Orifice and Model XLD, Grunau Sprinkler, Aug., 1977, (four sheets).

Parts List Sheet entitled "Grunau Model XLD .64 Orifice Upright", Grunau Sprinkler (Aug., 1978) (1 pg.).

Viking Technical Data sheet entitled "High Challenge™ Upright Sprinkler", The Viking Corp., Mar., 1977 (1 pg.).

Equipment Application Data sheets entitled "High Challenge® Sprinklers/Application Report: Digital Equipment Corporation", the Viking Corp., May, 1986 (4 pp.).

N. J. Thompson, *Fire Behavior and Sprinklers,* Chapter 6 "Automatic Sprinkler Protection", National Fire Protection Association, 1964, Cover, Foreward, Table of Contents and pp. 72–91.

Newsletter for Fire Protection Engineers and Industry, No. 11, Jul., 1965, Orinda, California (8 pp.).

Technical Report entitled "Optimization of Sprinkler Protection for United States Postal Service III. Protection of Plastic Letter Trays", Factory Mutual Research Corporation, Oct. 1971 (39 pp.).

Technical Report No. AFWL–TR–72–entitled "Fire Protection Study USAF Mobility Program Structures and Large Air Force Warehouses Phase 2", Factory Mutual Research Corporation, Nov., 1972 (65 pps. with cover and introductory pages).

Technical Report entitled "Protection of Idle Polyethylene Plastic Palettes with Viking Prototype Sprinklers (0.64 in. Orifice)", Factory Mutual Research Corporation, Jan., 1974, (29 pp. with cover and introductory pages).

Technical Report entitled "Optimization of Sprinkler Protection for United States Postal Facilities/IV Protection of Plastic Letter Trays with 0.64–IN. Retrofit Sprinklers", Factory Mutual Research, Jul., 1974 (30 pps. with cover and introductory pages).

Technical Report entitled "Development of Large Drop Sprinklers (0.64–IN. Orifice Diameter)", Factory Mutual Research Corp., Jun., 1976 (38 pp. including cover and introductory pages).

SFTE Bulletin, 77–2, Apr., 1977, Boston, MA, (pp. 1, 7 and 8).

"File Ex643 Project 8ONK16583 Report on Automatic Sprinklers", Underwriters Laboratories, Inc., May, 1981 (18 pp.).

Technical Report entitled "Large–Drop Automatic Sprinklers", Factory Mutual Research Corp., Feb., 1982 (76 pp. with cover and introductory pages).

*Fire Protection Handbook Fifteenth Edition*, National Fire Protection Association, Sep., 1981, Title Sheet, Inner Sheet and pp. 17–32 through 17–40.

*Fire Protection Handbook, Sixteenth Edition,* National Fire Protection Association, Mar., 1986 (Title Sheet, Inner Sheet, Table of Contents pg. xi and pp. 18–2 through 18–26, 18–36 through 18–59 and 18–77 through 18–82).

*Approved Product News*, Factory Mutual Engineering Corp., vol. 4, No. 2, Dec., 1988, pp. 1–5, 8–12 and 16.

*Fire Protection Handbook, Seventeenth Edition,* National Fire Protection Association, 1991, Title page, inner page, Table of Contents pg. ix and pp. 5–127 through 5–163 and 5–174 through 5–197.

K. Bell, "Presentation to American Fire Sprinkler Association—Large K–Factor Sprinklers", Nov., 1992, (59 pp. total: 19 pp. text and 40 pp. slide photocopies).

*Sprinkler Tech Notes,* National Fire Sprinkler Association, Inc., vol. XVII, Nov. 5, Dec., 1994 (12 pp.).

New Product Announcement, "Model G and GFR XLO Extended Coverage Ordinary Hazard Sprinklers", The Reliable Automatic Sprinkler Co., Inc., Mar., 1993, (one page).

Bulletin 128, "Model G XLO–ECOH Model GFR XLO–ECOH Extended Coverage Ordinary Hazard Pendent and Recessed Pendent Sprinklers", The Reliable Automatic Sprinkler Co., Inc., Feb., 1993, (2 pp).

Bulletin 128, Addendum, "Model G and GFR ECOH Pendent and Recessed Pendent Sprinklers Design Criteria Addendum", The Reliable Automatic Sprinkler Co., Inc., Mar., 1993 (one page).
Bulletin 124, "Model G XLO–ECOH Extended Coverage Ordinary Hazard Upright Sprinkler", The Reliable Automatic Sprinkler Co., Inc., Jul., 1993 (2 pp.).
Bulletin 160, "Model GFR VELO–ECOH Extended Coverage Ordinary Hazard Pendent and Recessed Pendent Sprinklers", The Reliable Automatic Sprinkler Co., Inc., Jul., 1993, (2 pp.).
Bulletin 127, "Model G XLO–EC Extended Coverage Light Hazard Pendent and Recessed Pendent Sprinklers", The Reliable Automatic Sprinkler Co., Inc., Feb., 1993 (2 pp.).
Reliable New Product Announcement "Model G XLO Extended Coverage Light Hazard Sprinklers", The Reliable Automatic Sprinkler Co., Inc., Mar., 1993, (one page).
Sheet entitled "Light Hazard XLO Extended Coverage" and Ordinary Hazard XLO Extended Coverage, The Reliable Automatic Sprinkler Co., Inc., Mar., 1993, (pp. 8A and 8B).
Grinnell Product Bulletin entitled "Extended Coverage Ordinary Hazard Sprinklers Pendent & Recessed Pendent Model F987 Designer, K = 11.4", Grinnell Corporation, Oct., 1993 (5 pp.).
Viking Technical Data sheet entitled "Model M Extended Coverage Ordinary Hazard Extra Large Orifice Sprinkler", The Viking Corporation, Jun., 1993, (pp. 83a–83c).
Viking Technical Data sheet entitled "Model M Extended Coverage Light Hazard Extra Large Orifice Sprinkler", The Viking Corporation, Jan., 1994, (pp. 85a–85c).
Viking Technical Data sheet entitled "Model M Quick Response Extended Coverage Light Hazard Extra Large Orifice Sprinkler", The Viking Corporation, Jan., 1994, (pp. 71a–71c).
Technical Data sheets for "Horizon® Model H Quick Response Flush Pendent Sprinkler", The Viking Corp., Jan., 1991, (pp. 53a, 53b).
Technical Data sheets for "Horizon® Model H Residential Pendent Sprinkler 4.2 K–Factor", The Viking Corporation, Mar., 1990 (2 pp.).
Technical Data sheets for "Horizon® Model H Residential/Extended Coverage Pendent", Viking Corporation, Nov., 1987 (2 pp.).
Catalog insert entitled "Flush Pendent Sprinklers, RES/QR–EC/EC Model F992 Aquarius®, ½" Orifice", Grinnell Corporation, Sep., 1989 (12 pp.).
Catalog insert entitled "Flush Horiz. Sidewall Sprinklers, RES/QR–EC/EC Model F993 Aquarius®, ½" Orifice", Grinnell Corporation, Jul., 1989, (8 pp.).
Catalog insert entitled "Flush Pendent Sprinklers Model F995 Aquarius®, ½ Orifice", Grinnell Corp. (4 pp.).
Bulletin 133 entitled "Model ZX–RES Mach 1 Flush Pendent Residential Sprinkler", The Reliable Automatic Sprinkler Co., Inc., Mar., 1989 (2 pp.).
Bulletin 133A entitled "Model ZX–RES Mach 1 Flush Pendent Horizontal Sidewall Residential Sprinkler", The Reliable Automatic Sprinkler Co., Inc., May, 1990 (4 pp.).
Data Bulletin for "Model '76 Royal Flush Concealed Sprinkler", Central Sprinkler Corp., Dec., 1978 (2 pp.).
Central Sprinkler Corp. drawing for "Deflector, Upright/.64 Orifice Sprinkler", last amended Nov. 18, 1986, Drawing No. B–131–09 REV. 6.
Sample Central Sprinkler Corp. D–64 Sprinkler with upright deflector of Drawing B–131–09 REV. 6.
Underwriters Laboratories, Inc., UL 199, Standard for Automatic Sprinklers for Fire Protection Service, Eighth Edition, Feb., 1990.
National Fire Protection Association (NFPA) 13, Installation of Sprinkler Systems, Feb., 1989.
Underwriters Laboratories, Inc., UL 1626, Standard for Safety—Residential Sprinklers for Fire–Protection Service, First Edition, Apr., 1988.
Factory Mutual Research, Approval Standard for Automatic Sprinklers for Fire Protection Service, Dec., 1983.
"Product Profile—First U.L. Listed Extended Coverage Ordinary Hazard Sprinklers", Fire Protection Contractor, May, 1992, (cover, pp. 46–50).
Factory Mutual Research, Approval Standard, Large Drop Sprinklers, Class No. 2007, Sep., 1979.
Factory Mutual, Loss Prevention Data, 2–7, "Installation Rules for Sprinkler Systems Using Large–Drop Sprinklers", Mar., 1990.
Underwriters Laboratories, Inc., UL 1767, Standard for Safety, Early–Suppression Fast–Response Sprinklers, First Edition, Feb., 1990.
Factory Mutual, Loss Prevention Data, 2–2, "Early Suppression Fast Response Sprinklers", Apr., 1987.
Factory Mutual, Approval Standard, Early Suppression Fast Response Automatic Sprinklers, Jun., 1986.
Viking, Technical Data, "Quick Response High Challenge Large Drop Sprinklers", Sprinkler, Jul. 26, 1989, pp. 115–116.
Data Sheet, ASCOA Fire Systems, "Automatic ESFR Glass Bulb Sprinkler", Mar., 1992, (pp. 1.1–1.2).
Grinnell Corporation, Data Sheet, "Early Suppression Fast Response Sprinklers, Model ESFR–1 Pendent, 14.3 K–FActor".
Reliable, Product Announcement, "ESFR, Model H, Early Suppression Fast Response Sprinkler", Oct., 1992.
Viking, Technical Data, "Aquamiser Model B Quick Response Specific Application Sprinkler", Sprinkler, May 31, 1991, pp. 117a, 117b, 117c.
Central Sprinkler Corporation, "The Omega' Commercial/Residential Quick Response Automatic Sprinkler, Model EC–20 Pendent", Aug., 1985.
NFPA, 1986 Fall Meeting, "Technical Committee Reports", pre–May, 1986, (cover, pp. 424–425).
NFPA, 1986 Fall Meeting, "Technical Committee Documentation", Nov., 1986, (cover, pp. 88–90, 11 ).
Reliable, "Model GXLO–ECOH, Model GFR XLO–ECOH, Extended Coverage Ordinary Hazard Sprinklers", Bulletin 128, (2 pgs.).
Central Sprinkler Corporation, Test Results for Extended Coverage Ordinary Hazard.
Central Sprinkler Corporation, Videotape (VHS), "The Optima Sprinklers, Extended Coverage Ordinary Hazard Sprinkler Testing (ELO–16, ESLO–20)".
Advertisement for Aquamiser™; The Viking Corporation, 210 N. Industrial Park Road, Hastings, MI 49058. (undated).
Central Sprinkler catalog insert for Omega™ EC–20A (EC–20A 4–87); Central Sprinkler Corporation, 451 North Cannon Avenue, Lansdale, PA 19446. Apr., 1987.
Central Sprinkler Bulletin AS–D.64 Rev. No. 3 "Extra Large Orifice Automatic Sprinkler Model 'D.64' Upright"; Central Sprinkler Corporation. Aug., 1985.
"New Product Profile: First U.L. Listed Extended Coverage Ordinary Hazard Sprinklers", May 1992, *FPC/Fire Protection Contractor*, pp. 46 to 50.

EXTENDED COVERAGE CEILING SPRINKLERS AND SYSTEMS

This application is a continuation-in-part of U.S. patent application Ser. No. 07/875,928 filed Apr. 29, 1992, now U.S. Pat. No. 5,366,022 issued Nov. 22, 1994, which is a continuation-in-part of Ser. No. 07/769,917 filed Sep. 30, 1991, now abandoned.

BACKGROUND OF THE INVENTION

Heretofore, thinking in the fire protection art has been directed towards the use of multiple sprinklers for the protection of interior areas more than about one to two hundred square feet so as to limit the maximum average area protected by each sprinkler. As the perceived fire threat rises, the recommended protected area of coverage for each sprinkler is reduced. Such thinking has been embodied, for example, in accepted industry standards such as the Standard for the Installation of Sprinkler Systems, NFPA-13, issued by the National Fire Protection Association, and Standard 199 issued by Underwriters Laboratories, Inc. Existing versions of both standards and all prior, superseded versions of both standards are incorporated by reference herein.

NFPA-13 defines various requirements for sprinkler systems utilized in occupied commercial interior spaces or "occupancies" with different fire hazard potentials. The NFPA-13 recognizes three general hazard categories for sprinkler systems: light, ordinary and extra. As defined by the NFPA-13, light hazard occupancies are those where the quantity and/or combustibility of contents is low and fires with relatively low rates of heat release are expected. Ordinary hazard covers those occupancies where the quantity and/or combustibility of the contents is equal to or greater than that of light hazard, ranging from low to high, where the quantities of combustibles is moderate and stock piles do not exceed twelve feet, such that fires with moderate to high rates of heat release are expected. Extra hazard occupancies are those where quantity and combustibility of the contents is very high and flammable or combustible liquids, dust, lint or other materials are present, such that the probability of rapidly developing fires with high rates of heat release is very high. The present invention is directed specifically to the protection of light and ordinary hazard occupancies, which define the bulk of most potential commercial installations.

The aforesaid application Ser. Nos. 07/875,928 and 07/769,917 disclose both upright and pendant frame-type ceiling sprinklers which have been tested and listed by Underwriters Laboratories, Inc. as providing both light and ordinary hazard protection for extended coverage of up to 400 square feet (20×20). All of the sprinklers disclosed in these applications are frame-type sprinklers and must be at least partially if not totally exposed beneath the ceiling over the floor area to be protected by the sprinkler.

While such sprinklers are eminently functional, their exposure and appearance generally make them less desirable for applications in which aesthetics may be a consideration in the sprinkler purchase. Accordingly, it would be desirable to provide at least partially recessed and preferably concealed ceiling sprinklers capable of providing extended coverage for at least light hazard applications.

SUMMARY OF THE INVENTION

The invention is a ceiling sprinkler comprising: a generally tubular body having an outlet orifice at one end, the tubular body having a K factor greater than 9, where K equals the flow of water in gallons per minute through the tubular body divided by the square root of the pressure of the water fed into the tubular body in pounds per square inch; a plug positioned in the outlet orifice so as to at least generally close the outlet orifice; a temperature responsive device releasably retaining the plug in the outlet orifice; a deflecting structure having a major surface facing the outlet orifice; and at least one axially extending member at least indirectly retainably coupled with the deflecting structure and at least indirectly movably and retainably coupled with the sprinkler body so as to secure the deflecting structure with the sprinkler body for axial movement of the deflecting structure from an initial position with respect to the outlet orifice to a displaced distal position spaced farther away from the outlet orifice than is the initial position.

BRIEF DESCRIPTION OF THE DRAWINGS

The foregoing summary, as well as the following detailed description of preferred embodiments, will be better understood when read in conjunction with the appended drawings. For the purpose of illustrating the invention, there is shown diagrammatically in the drawings embodiments which are presently preferred. It should be understood, however, that the invention is not limited to the specific embodiments, instrumentalities, elements and methods disclosed. In the drawings, which are diagrammatic.

DETAILED DESCRIPTION OF THE PREFERRED EMBODIMENTS

Figure 2:
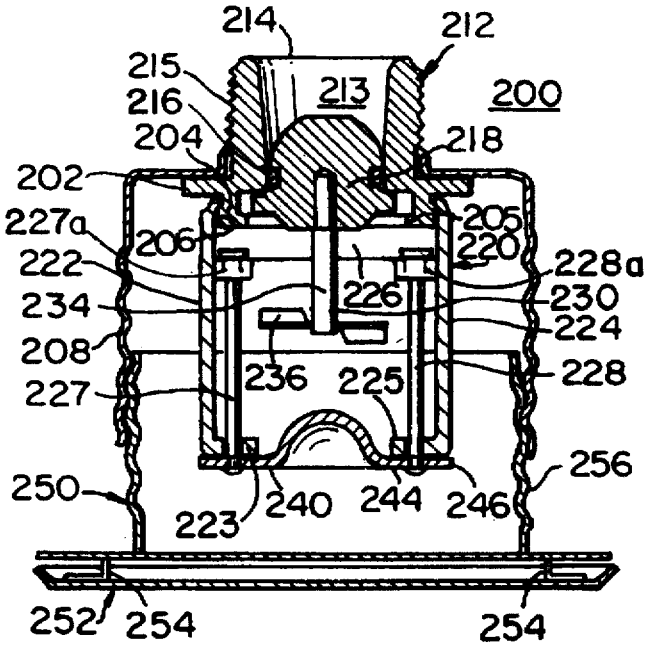
FIG. 2 depicts in side elevation a concealed ceiling sprinkler.

Certain terminology is used in the following description for convenience only and is not limiting. The words "right", "left", "lower" and "upper" designate directions in the drawings to which reference is made. The words "radially" and "axially" refer to directions perpendicular to and along a central axis of an object, element or structure referred to while the words "inwardly" and "outwardly" refer to directions towards and away from, respectively, the geometric center of the device, or structure. The terminology includes the words above specifically mentioned, derivatives thereof and words of similar import. Moreover, throughout the drawings, like numerals are used to indicate like elements.

Figure 1:
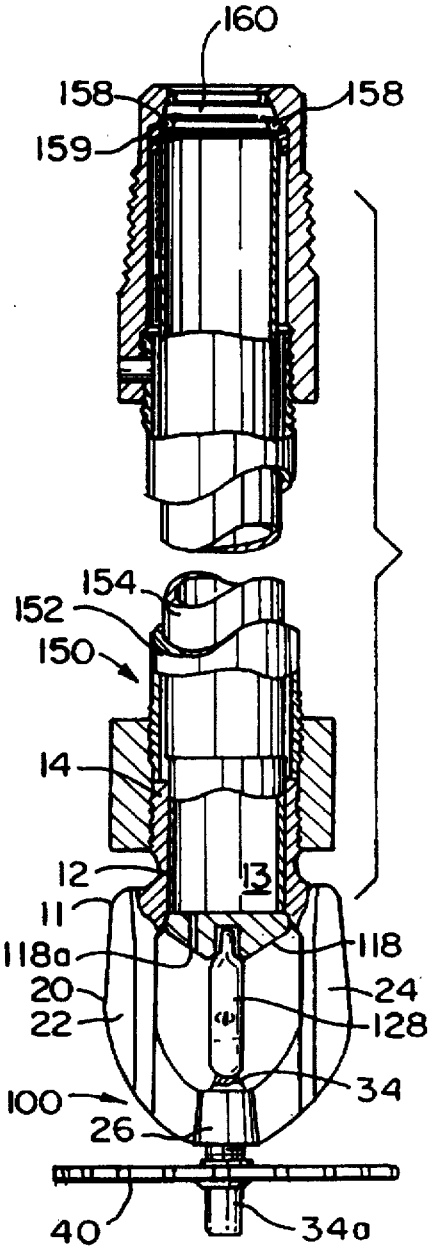
FIG. 1 depicts in partially broken side elevation, a dry pendant sprinkler head.

FIG. 1 depicts a sprinkler 100 of the present invention in a dry pendent configuration indicating generally at 100. Dry pendent sprinkler 100 includes a one-piece frame arm 11 with tubular body 12 and adjoining yoke 20 and pendent style deflector 40 of the type previously disclosed in U.S. patent application Ser. Nos. 07/875,928 filed Apr. 29, 1992 and 07/769,917 filed Sep. 30, 1991, both assigned to the assignee of this application and incorporated by reference herein in their entireties. Also incorporated by reference is International patent application Ser. No. PCT/US92/08750 filed Sep. 30, 1992. Plug 118 differs from the plugs disclosed in those prior applications in that it is provided with a tiny passage 118*a* to relieve condensation which may be trapped within the body 12 and is further releasably retained in the outlet orifice by a thermal responsive release device 128 in the form of an alcohol-filled bulb bearing the same reference numeral. Device 128 may simply be a thermally responsive, frangible bulb as described, or a thermally released link and lever device like 228 in FIGS. 2 and 3, or any other suitable, thermally frangible or otherwise thermally operative releasable device or suitable, electrically released device might be used including but not limited to those described in the aforesaid U.S. patent application Ser. Nos. 07/875,928 and 07/769,917. Such release devices and many others which can currently be employed in such sprinklers and which may be designed in the future for use in such sprinklers are intended to be included in this invention. Adjustment screw 34 is provided with a pintal 34*a* at its extreme distal end which provides a convenient means for threading adjustment screw 34 through knuckle 26 and adjusting compression on the thermal responsive release element 128. Adjustment screw 34 can be used to support the deflector 40 as shown or the deflector may be secured to the knuckle 26 of the frame in a conventional fashion by swaging. The inlet end 14 of the body is coupled with a conventional dry pendent assembly, indicated at 150. Assembly 150 includes an outer tube 152 and inner tube 154 extended into passageway 13 and supported on plug 118, a plurality of ball bearings 145 supported by a thrust bearing 159 on inner tube 154 and supporting a seal member 160 pressed against a turned inlet end of the outer tube of the assembly 150, which is itself threaded into a conventional "T" fitting on a branch line or other supply conduit.

One aspect of the present invention is the use of sprinkler bodies having "extra large" and "very extra large" orifice sizes with higher K factors. In particular, sprinkler bodies of the present invention have K factors greater than those of standard orifice and even large orifice sprinklers. Large orifice sprinklers have K factors of 7.4 to 8.2±5 percent (or a maximum K factor of 8.7). Preferably "extra large" orifices of about 0.64 inches and "very extra large" orifices of about 0.70 inches in diameter, respectively, are used to provide K factors greater than 9 and more typically between about eleven and about fourteen, respectively. Extra large orifice sprinklers as used herein are those having K factors of 11.0–11.5 (±5 percent), while very extra large orifice sprinklers as used herein are those having K factors of 14.0–14.5 (±5 percent), or whichever comparable K factors limits of about 11 and about 14 that Underwriters Laboratories, Inc. and/or NFPA may specifically define for such sprinklers. The present invention relates to such oversized sprinklers having K factor greater than 9 which are larger than "large" orifice sprinklers.

Sprinklers of the present invention with such extra large and very extra large orifices are capable of supplying relatively larger volumes of water while lowering the minimum water pressures which must be provided to produce such flows and extended distributions. The major benefit which arises from this approach is the possibility of eliminating the need to provide a supplemental pump to boost the water pressure needed to achieve the distribution.

While applicants have successfully demonstrated superior fire suppression capability with extra large and very extra large size orifices, it will be apparent that orifice sizes between the two should also offer satisfactory performance. Based upon experience to date, it is further believed that K factors into the mid 20's (e.g. about 25), which might be provided by an orifice up to one inch in diameter, should also provide water discharges that can be satisfactorily distributed over an area of at least 400 square feet (e.g. 20×20), provided pressure at the orifice is at least about 5 psi and desirably about 7 psi or more but still less than about 35 psi, preferably 25 psi or less, to obviate any need for supplemental pressure boosting. Accordingly, it may be possible and even advantageous to use such larger orifices for ordinary and extra ordinary extended coverage applications under NFPA 13 as well as other, high or higher hazard applications.

While frame-type sprinklers have been disclosed in applicants' prior extended coverage sprinkler applications and are disclosed in FIG. 1, the teachings of the present invention can and have been incorporated into concealed, drop-down type ceiling sprinklers of the various types described, for example, in U.S. Pat. Nos. 4,014,388, 4,491,182, 4,508,175, 4,618,001, 4,630,688, 4,976,320, 5,083,616, and 5,094,198, and application Ser. Nos. 07/769,917 and 07/875,928 filed 30, Sep. 1991 and 29, Apr, 1992, each assigned to the assignee of this application and incorporated by reference herein.

Figure 3:
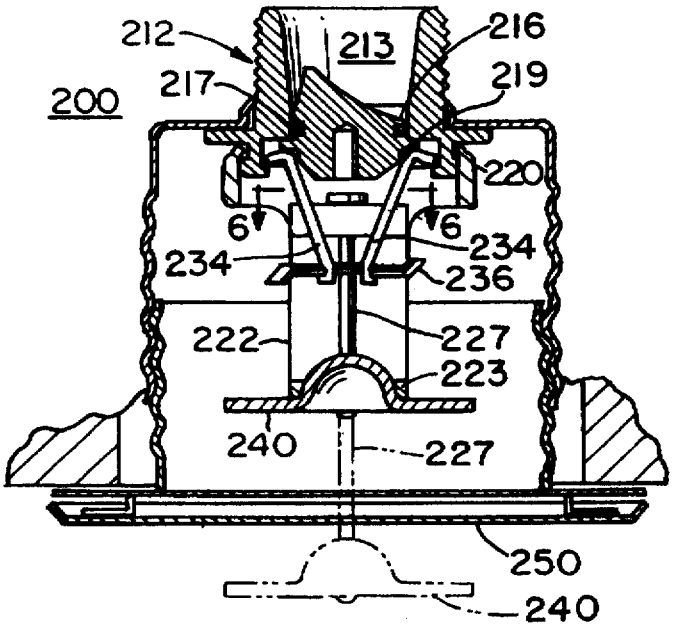
FIG. 3 is a second partially broken away side elevation of the sprinkler of FIG. 2 rotated 90°.

FIGS. 2 and 3 depict orthogonal sectioned elevations of a first concealed sprinkler embodiment indicated generally at 200 which includes a tubular body portion 212 supporting a deflecting structure support or, more simply, a deflector support 220. Body 212 defines a passageway 213 having one open end defining an inlet 214 and an opposing open end defining an outlet orifice 216 releasably receiving plug 218, which closes the orifice until activation of the sprinkler 200. Projecting radially outwardly from the body 212 at the outlet orifice end is an annular flange 202 which in turn supports a tubular extension 204 of the body. The remote end of the tubular extension 204 is flared radially inwardly and outwardly to provide outer and inner circular or at least arcuate flanges 205 and 206, respectively. In a "wet" sprinkler like sprinkler 200, plug 218 has no opening therethrough so as to permit the sprinkler 200 to be pressured with water before actuation.

Preferably, deflector support 220 includes a cylindrical collar portion 226 supporting a pair of symmetric, arms 222 and 224. Deflector support 220 and each of its arms 222, 224 extend generally axially away from the one outlet end of the sprinkler body and away from the outlet orifice 216 itself. The remote end of each arm is inwardly turned to provide an inward flange portion 223 and 225, respectively. Axial bores through the flange portions 223 and 225 slidingly receive movable support elements preferably including guide pins 227 and 228, respectively. Preferably, axial ends of the guide pins 227 and 228 proximal the inlet end of the sprinkler are outwardly flared in an appropriate manner so as not to pass through stop members 227*a* and 228*a*, which are mounted on the pins 227, 228 at the axial end of each pin which is closest (proximal) to the inlet end of the sprinkler body 212. In this way, the proximal end of each pin 227 and 228 is at least indirectly movably yet retainably coupled to the sprinkler body 212 through support 220. The remaining distal ends of the pins 227 and 228 are at least indirectly retainably coupled with the deflecting structure 240 and, preferably, are directly fixedly coupled to the deflecting structure 240 by conventional means such as passing the distal end of each pin 227, 228 through a bore in deflecting structure 240 and swaging the pin end on the structure 240 in a conventional fashion.

FIG. 3 illustrates the use of a link-lever assembly 230 as the thermally responsive device to releasably retain the plug 218 in the sprinkler orifice until activation. Preferably a pair of identical levers 234 are provided each with two axial ends turned in the same direction from the main axis of the lever. One turned axial end of each lever is supported on the inner circular flange 205 of the body 212 while the elbow of the turn is received in one of two identical, diametrically opposed recesses 219 provided in the outer surface of the plug 218. The arms of a pair of identical, generally U-shaped, generally planar links 236 are overlapped and held together with solder around the remaining, distal-turned ends of each of the levers 230, holding those ends of the levers 234 in compression. Thus, the link-lever assembly is at least indirectly and is, preferably, directly coupled between the plug 218 and the body 212 to releasably retain plug 218 in orifice 216. In this way, the systemic loads provided by water within the sprinkler body 212 on the plug 218 are supported solely by the levers 234, the links 236 and the solder connection(s) of the links. The deflector support 220 is not subject to any systemic loads before activation of the sprinkler.

Preferably an adjustable ceiling cover 250 is provided by a plate 252 attached to legs 254 of a tubular mounting collar 256 by thermally responsive means such as solder. The outer tubular side of the collar 256 is preferably corrugated to be received within a corrugated tubular bracket 208 which is, in turn, wrapped over or threaded onto and supported on the annular flange 202 and against the body 212 for adjustable positioning of the plate 252 with respect to the deflector 240. At least one-half inch and preferably at least an inch or more of vertical adjustment of the cover plate 252 is provided through the collar 256 and tubular bracket 208.

The body of an extra large orifice sprinkler 212 has a nominal height of about one inch, with an internal passageway having an inlet diameter of about 0.74 inches tapering conically downward at an included angle of about twelve degrees (six degrees per side) for about one-half inch to an orifice diameter of about 0.627 inches, which is maintained for about two-tenths of an inch. The orifice diameter is the narrowest actual or effective diameter provided along the water passage through the sprinkler body. The outlet end of the sprinkler beyond this constant diameter (orifice) region is expanded and again configured suitably to receive and release a plug and support deflecting structure support 220.

Figure 4:
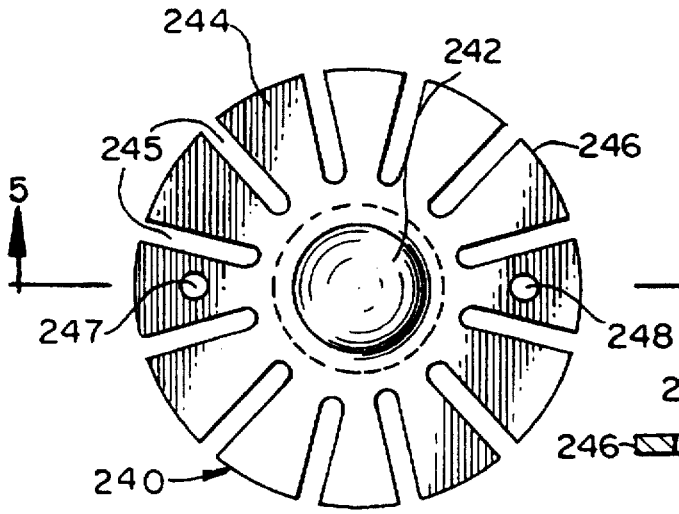
FIG. 4 is a plan of the deflector of the sprinkler of FIGS. 2 and 3.
Figure 5:
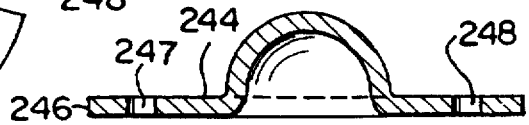
FIG. 5 is a side section of the deflector of FIG. 4 taken along the lines 5—5 of FIG. 4.

FIGS. 4 and 5 depict the deflecting structure 240 in orthogonal views. Preferably, deflecting structure 240 is provided with a slotless central area including a central protrusion 242 extending axially towards the plug 218 and is surrounded by an essentially planar annular portion 244 provided with a plurality of slots 245 extending axially through the deflecting structure and radially inwardly from an outer, circular perimeter 246. Diametrically opposed bores 247, 248 receive the distal ends of guide pins 227 and 228. Slots 245 should not extend inwardly so far as to overlap the outlet orifice or actually extend into the water column issuing from the outlet so that at least essentially all water issuing from the outlet orifice is forced to strike the central protrusion or the annular solid area of the deflecting structure immediately surrounding the protrusion between the protrusion and the innermost edge of the slots. For the cited extra large orifice sprinkler body, applicants have used a deflecting structure formed by an annular plate about 1.35 inches in outer diameter provided with 12 slots each about 0.062 inches wide and 0.36 inches deep and a generally hemispherical protrusion having a quarter-inch spherical radius and slightly more than one-quarter inch high mounted on the plate. Other dimensions and/or shapes could be employed.

The slotless central area has a diameter equal to the about 1.35 inch outer diameter of the deflecting structure less twice the 0.36 inch depth of each slot or about 0.63 inches, which is about equal to or greater than the 0.627 inch orifice diameter.

It will be appreciated that the ratio of the diameter of the circular outer perimeter of the deflecting structure (about 1.35 inches) to the depth or radial length of each of the plurality of slots (0.36 inches), is about 3.75.

It will further be appreciated that as was previously disclosed applicants' priority application Ser. No. 07/875,928, now U.S. Pat. No. 5,366,022, all of the slots extending radially inwardly from the outer perimeter of the deflecting structure collectively provide a total open area of at least about ten percent and no more than about thirty percent of the total surface area of the deflecting structure. As with the prior embodiments, this relationship applies to the present deflecting structure whether that area is measured directly on the surface of the deflecting structure facing the one end of the tubular body or whether that area is measured on a plane perpendicular to a central axis through the outer orifice. The calculation to confirm this relationship is straight forward.

It has been found that protrusion 244 or an equivalent protrusion is desired if not required in order to get a range of distribution of water issuing around the sprinkler from the water column. Preferably, the outer diameter or maximum dimension of the protrusion 244 is comparable to but less than the outer diameter of the water column reaching the protrusion 244 and the outer surface of the protrusion is preferably rounded in an axial direction (e.g. generally semi-elliptical or hemispherical) as opposed to straight-sided (e.g. conical) to provide a continuous range of angles of reflection of water from the column onto the annular portion 244 surrounding the protrusion and beyond the outer edge of the deflecting structure 240. It has been found, for example, that with the sprinkler body having an extra large orifice, the diameter of the water column is approximately 9/16ths inch in diameter. The protrusion should have a diameter of approximately one-half inch (outer surface diameter). When used with a deflecting structure having an overall outer diameter of about 1" to 1⅜", distributions of twenty-by-twenty feet for at least light hazard densities have been achieved. It is believed that by appropriate manipulation of the shape and dimensions of the protrusion, the outer diameter of the annular portion, the outer diameter of the deflecting structure and the numbers, widths and lengths of the slots, that extended coverage ordinary hazard density distributions also can be achieved with such concealed sprinklers.

Sprinkler 200 is installed by threading the body 212 into an appropriate supply stem with the plug 218, thermally responsive release assembly 230 and tubular bracket 208 installed. Guide pins 227 and 228 can be withdrawn into the housing 220 as shown in FIGS. 2 and 3 and retained by a clip or spring (not shown) or the deflecting structure 240 can be permitted to drop and rest on the upper surface of the cover plate 252 when cover 250 is mounted to bracket 208 at the end of installation.

In operation, heat is absorbed by the ceiling cover 250 and, when an appropriate temperature is reached (135° F./57° C. for quick release), melts the solder holding the plate 252 to legs 254 of the mounting collar 256, releasing the plate 252 and exposing the thermally responsive release assembly 230 to direct heating. When heated to an appropriate temperature (165° F./74° C. for quick release), the solder holding together the individual link members 236 melts, releasing the levers 234, which in turn release the plug 218. The plug 218 is blown from the orifice by the water pressure behind it striking the top of the deflector 240 and driving the pins 227, 228 downwardly until stop members 227*a* and 228*a* abut the inwardly turned distal ends 223, 225 of arms 222, 224. When fully deployed, the plane of the deflecting structure is preferably about one-half inch or more below the lower surface of the ceiling in which the sprinkler 200 is installed and about two and one-half inches from the outlet orifice end of the extra large orifice body 212. Other spacings have been and can be used.

The aforesaid embodiment sprinkler has been successfully tested to UL standards for extended coverage, light hazard protection. Accordingly, when the deflector of this sprinkler is positioned 7.5 feet above a collection area and water is passed through the sprinkler at a pressure to provide a density of 0.1 GPM/ft$^2$ over a selected protection area (e.g. 20×20 feet), the sprinkler delivers more than a trace amount of water in each square foot of the distribution area and further when installed at an operating height in a test room having eight foot high walls and the maximum dimensions sought to be listed (20×20 feet), the sprinkler wets the entire area of the wall surfaces to a minimum height of thirty inches above the floor after one minute of operation at the minimum water flow rate to be used for the sprinkler (0.1 GPM/ft$^2$) for the test area. The aforesaid sprinkler has been UL tested for quick response coverage from 8×8 feet up to 18×18 feet and for standard response coverage up to 20×20 feet. The dimensions indicate allowed spacings between sprinklers on the same pipe and between adjoining parallel pipes with the sprinklers. Such light hazard coverages for up to 20×20 feet are provided with water pressures much less than 35 psi, more specifically at pressures between about 5 and 15 psi.

Figure 7:
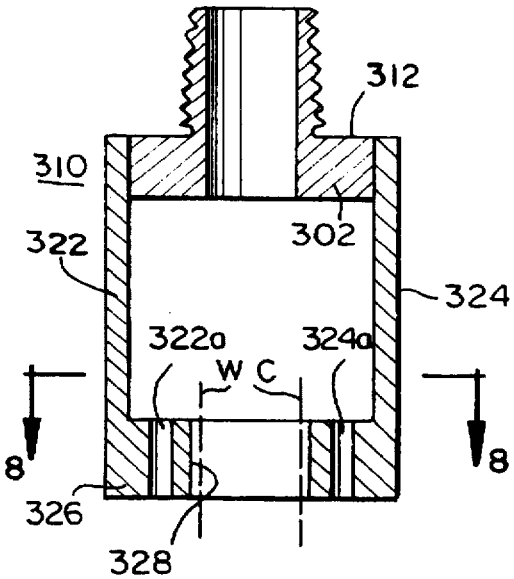
FIG. 7 is a side elevation of a second concealed sprinkler frame for extended coverage.
Figure 8:
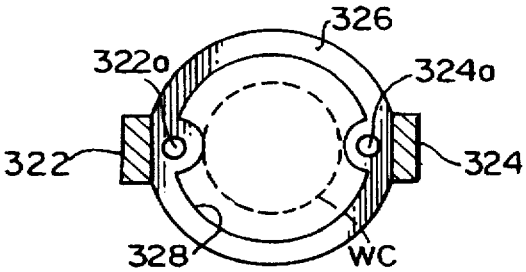
FIG. 8 is a sectioned plan elevation taken along the lines 8—8 in FIG. 7.
Figure 6:
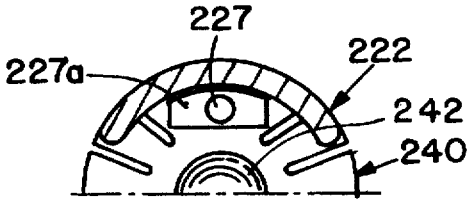
FIG. 6 is a sectioned plan elevation taken along the lines 6—6 of FIG. 3.

FIGS. 7 and 8 are views of an alternate combination sprinkler body and deflecting structure support 310, which can be substituted for the body 212 and support 220 of FIGS. 2 and 3, or which can be otherwise modified so as to be used with other known arrangements for supporting a thermally responsive release assembly or element from only the body 312 so as to avoid imposing any systemic load from the water pressure in the body 312 on the deflecting structure support 320. Diametrically opposed, axially extending arms 322 and 324 are supported from a radially outwardly extending flange portion 302 of the body 312, the outer perimeter of which may be provided with plural sets of parallel opposing surfaces for receiving a wrench. An annular web 326 is supported at the ends of the arms 322 and 324 remote from the flange portion 302 of the body 312. Bores 322*a* and 324*a* are provided through web 326 to slidingly receive individual support members like pins 226, 228 which are at least indirectly retainably coupled to a deflecting structure like deflecting structure 240 and to support the pins and deflecting structure from arms 322, 324 thereby at least indirectly movably yet retainably coupling the deflecting structure with the sprinkler body 312. Opening 328 through annular web 326 permits free passage of water column "WC" issuing from the outlet orifice of the body.

While preferred embodiments of the inventions have been disclosed, such preferred embodiments are considered exemplary. For example, while two possible configurations for a concealed sprinkler are disclosed, a number of other configurations are possible. For example, if a deflecting structure support is provided, such support may be a continuous length of tube or have as few as one and more than two specific "arms" extending from the body to support the guide pin(s). Moreover, it should be appreciated that the guide pin support may be eliminated entirely and the guide pins supported directly from a flange extending radially outwardly from the sprinkler body, preferably provided near the outlet end of the body in the manner shown, for example, in U.S. Pat. Nos. 4,491,182 and 4,926,946, both incorporated by reference herein, or the support structure telescope itself along the sprinkler body.

What is significant among all these concealed sprinkler designs is the elimination of the yoke 20, including the arms and knuckle, which extend into the flow of water or other fire-retarding liquid flowing through the outlet orifice of the sprinkler after activation. The sprinkler designs of FIGS. 2–8 present a substantially if not essentially unimpeded flow of the water column through the outlet orifice to the facing major side of the deflecting structure. It has been found that this unimpeded flow also permits a uniform extended coverage distribution to be provided with a deflecting structures generally smaller in size than those previously disclosed by applicants with frame-type sprinklers.

One of ordinary skill will further appreciate that having demonstrated the ability to distribute water with adequate densities over such extended areas with the disclosed deflectors, that it would be possible to distribute water with other deflector configurations. Most simply, the relative dimensions of the disclosed deflectors can be varied simply by varying the spacing of the deflector from the proximal sprinkler body end. However, it is believed that all subsequent versions of this invention will adopt a generally horizontal spray pattern of large droplets which characterize the distribution patterns of the preferred deflectors and sprinklers of the present invention.

It is further suggested that thermally responsive elements used in the sprinkler be selected to provide the quickest response times possible to activate the sprinklers as quickly as possible after the beginning of a fire. It is suggested that the temperature responsive element have a response time index ("RTI") of less than one hundred and preferably less than fifty. It is believed that such a response time index can be achieved in several ways, for example, by variations in the wall thicknesses of glass bulb release elements of the type previously noted or the use of appropriate low melting temperature solders and alloys.

It should be understood, therefore, that this invention is not limited to the particular embodiments or instrumentalities shown, but is intended to cover all modifications which are within the scope and spirit of the invention as defined by the appended claims.

We claim:

1. A ceiling sprinkler comprising:

a generally tubular body having an outlet orifice at one end, the tubular body having a K factor greater than 9, where K equals the flow of water in gallons per minute through the tubular body divided by the square root of the pressure of the water fed in to the tubular body in pounds per square inch;

a plug at least generally closing the outlet orifice;

a temperature responsive device releasably retaining the plug in the outlet orifice;

a deflecting structure having a major surface facing the outlet orifice; and at least a first axially extending member at least retainably coupled with the deflecting structure and at least movably and retainably coupled with the tubular body so as to secure the deflecting structure with the tubular body for axial movement of the deflecting structure with respect to the outlet orifice from an initial position to a displaced distal position, the displaced distal position being spaced farther away from the outlet orifice than the initial position is spaced from the outlet orifice;

wherein the deflecting structure includes a central protrusion extending axially towards the plug and an outer annular portion having an outer perimeter with a plurality of slots extending axially entirely through the deflecting structure and radially inwardly from the outer perimeter towards the central protrusion; and wherein the protrusion has an outer diameter and the tubular body has an orifice diameter greater than the outer diameter of the protrusion.

2. The ceiling sprinkler of claim 1 further comprising a second axially extending member, each of the first and second axially extending members being fixedly coupled at one end to opposed sides of the deflecting structure and being movably and retainably coupled at a remaining end from the tubular body.

3. The ceiling sprinkler of claim 2 further comprising a pair of arms extending axially away from the one end of the tubular body and the outlet orifice, on opposite sides of the outlet orifice, each of the first and second axially extending members being movably secured with a separate one of the pair of arms.

4. The ceiling sprinkler of claim 3 wherein the pair of arms extend from and are fixedly secured with the tubular body.

5. The ceiling sprinkler of claim 2 further comprising a deflector support fixedly coupled at one end with the tubular body and extended axially away from the one end of the tubular body and away from the outlet orifice, each of the first and second axially extending members being movably secured with the deflector support.

6. The ceiling sprinkler of claim 1 wherein the outer perimeter is circular with a diameter and wherein a ratio of the diameter of the circular outer perimeter of the deflecting structure to a radial length of each of the plurality of the slots is about 3.75.

7. The ceiling sprinkler of claim 6 wherein the ratio of the diameter of the circular outer perimeter of the deflecting structure to the radial length of all slots extending radially inwardly from the circular outer perimeter is about 3.75.

8. The ceiling sprinkler of claim 1 wherein all slots in the deflecting structure extending radially inwardly from the outer perimeter are of the same radial length and width and are uniformly spaced from one another around the outer perimeter.

9. The ceiling sprinkler of claim 1 wherein all slots extending radially inwardly from a outer perimeter of the deflecting structure collectively provide a total open area of at least about ten percent and no more than about thirty percent of the total surface area of the deflecting structure measured on a plane perpendicular to a central axis through the outlet orifice.

10. The ceiling sprinkler of claim 1 wherein the tubular body has an orifice diameter, wherein the deflecting structure includes a slotless central area with the protrusion and wherein the slotless central area has a diameter greater than the orifice diameter.

11. The ceiling sprinkler of claim 1 wherein the protrusion is rounded in an axial direction.

12. The ceiling sprinkler of claim 1 wherein the outer perimeter is circular and wherein the total open area provided by the slots is at least about ten percent and no more than about thirty percent of total actual surface area of one side of the deflector facing the outlet orifice within the circular outer perimeter as measured on a plane perpendicular to a central axis through the outlet orifice.

13. A ceiling sprinkler comprising:

a tubular body having an outlet orifice at one end, the tubular body having a K factor greater than 9 where K equals the flow of water in gallons per minute through the tubular body divided by the square root of the pressure of water fed into the tubular body in pounds per square inch;

a plug closing the outlet orifice;

a thermally responsive device releasably retaining the plug closing the outlet orifice;

a deflector support extended generally axially away from the one end of the tubular body; and a deflecting structure secured to the tubular body through the deflector support, the deflecting structure being positioned opposite and spaced from the outlet orifice, the deflecting structure including a central protrusion located directly opposite the outlet orifice and at least essentially lacking in openings which permit water from flowing from the outlet orifice to pass from the sprinkler axially through the central protrusion, the central protrusion extending axially towards the plug and being rounded in an axial direction, the deflecting structure further including an annular portion surrounding the central protrusion, the annular portion being provided with a plurality of slots extending axially entirely through the deflecting structure and radially inwardly from an outer perimeter of the deflecting structure;

wherein the outer perimeter of the deflecting structure is circular and wherein the total open area provided by the slots is at least about ten percent and no more than about thirty percent of total surface area of one side of the deflecting structure facing the outlet orifice within the circular outer perimeter of the deflecting structure.

14. The ceiling sprinkler of claim 13 wherein the protrusion has an outer diameter and the tubular body has an orifice diameter greater than the protrusion outer diameter.

15. The ceiling sprinkler of claim 13 wherein the outer perimeter of the deflector is circular and has an outer diameter and wherein ratios of the outer diameter to radial lengths of the plurality of slots are about 3.75.

16. The ceiling sprinkler of claim 15 wherein the plurality of slots constitute all slots spaced around the central protrusion and extending from the circular outer perimeter of the deflector generally radially inwardly towards the protrusion and axially entirely through the deflector.

17. The ceiling sprinkler of claim 13 wherein the outer perimeter is circular and has an outer diameter of about 1.35 inches.

18. A ceiling sprinkler comprising:

a generally tubular body having an outlet orifice at one end, the tubular body having a K factor greater than 9, where K equals the flow of water in gallons per minute through the tubular body divided by the square root of the pressure of the water fed into the tubular body in pounds per square inch;

a plug at least generally closing the outlet orifice;

a temperature responsive device releasably retaining the plug in the outlet orifice;

a deflecting structure having a major surface facing the outlet orifice; and at least a first axially extending member at least retainably coupled with the deflecting structure and at least movably and retainably coupled with the tubular body so as to secure the deflecting structure with the tubular body for axial movement of the deflecting structure with respect to the outlet orifice from an initial position to a displaced distal position, the displaced distal position being spaced farther away from the outlet orifice than the initial position is spaced from the outlet orifice;

wherein the deflecting structure includes a central protrusion extending axially towards the plug and an outer annular portion having an outer perimeter with a plurality of slots extending axially entirely through the deflecting structure and radially inwardly from the outer perimeter towards the central protrusion; and wherein the outer perimeter is circular with a diameter and wherein a ratio of the diameter of the circular outer perimeter of the deflecting structure to a radial length of each of the plurality of the slots is about 3.75.

* * * * *